US011619203B2

(12) United States Patent
Wustmann

(10) Patent No.: US 11,619,203 B2
(45) Date of Patent: Apr. 4, 2023

(54) HYDROSTATIC AXIAL PISTON MACHINE

(71) Applicant: Robert Bosch GmbH, Stuttgart (DE)

(72) Inventor: Walther Wustmann, Hoesbach (DE)

(73) Assignee: Robert Bosch GmbH, Stuttgart (DE)

( * ) Notice: Subject to any disclaimer, the term of this patent is extended or adjusted under 35 U.S.C. 154(b) by 20 days.

(21) Appl. No.: 17/489,002

(22) Filed: Sep. 29, 2021

(65) Prior Publication Data

US 2022/0106945 A1 Apr. 7, 2022

(30) Foreign Application Priority Data

Oct. 7, 2020 (DE) ..... 10 2020 212 630.5

(51) Int. Cl.

| | |
|---|---|
| ***F04B 1/2064*** | (2020.01) |
| ***F03C 1/06*** | (2006.01) |
| ***F04B 1/2021*** | (2020.01) |
| ***F01B 3/00*** | (2006.01) |
| ***F04B 1/2042*** | (2020.01) |

(52) U.S. Cl.

CPC ..... *F03C 1/0647* (2013.01); *F01B 3/0047* (2013.01); *F01B 3/0055* (2013.01); *F04B 1/2021* (2013.01); *F04B 1/2042* (2013.01); *F04B 1/2064* (2013.01)

(58) Field of Classification Search

CPC .... F03C 1/0647; F03C 1/0694; F01B 3/0047; F01B 3/0055; F04B 1/2021; F04B 1/2042; F04B 1/2035

See application file for complete search history.

(56) References Cited

U.S. PATENT DOCUMENTS 3,040,672 A * 6/1962 Foerster ..... F01B 3/0047 91/487
5,593,285 A * 1/1997 Watts ..... F04B 1/2021 91/499

FOREIGN PATENT DOCUMENTS

| | | |
|---|---|---|
| DE | 1 703 347 A1 | 1/1972 |
| DE | 2 104 933 A1 | 8/1972 |
| DE | 37 25 361 A1 | 2/1989 |

OTHER PUBLICATIONS

Bosch, Axial Piston Machine with a Revolving Cylinder Drum—("DE2104933A_MT") Machine Translation (original1971) (Year: 1971).*

* cited by examiner

*Primary Examiner* — Kenneth J Hansen
(74) *Attorney, Agent, or Firm* — Maginot, Moore & Beck LLP

(57) ABSTRACT

A hydrostatic axial piston machine includes a cylinder drum that rotates during operation and has a plurality of cylinder bores in which displacement pistons are arranged, each of which opens out in a control opening in one end face of the cylinder drum, and having a control part against which the cylinder drum bears with the end face and on which two kidney-shaped control ports in the form of circular arcs are provided. Between the two kidney-shaped control ports, a first changeover web and a second changeover web are formed, wherein two sets of compensating openings that are able to be overlapped by control openings are located in the changeover webs with one compensating opening of each set located in each changeover web, and the compensating openings in the two sets of compensating openings are connected together via respective compensating fluid paths.

13 Claims, 7 Drawing Sheets

HYDROSTATIC AXIAL PISTON MACHINE

This application claims priority under 35 U.S.C. § 119 to application no. DE 10 2020 212 630.5, filed on Oct. 7, 2020 in Germany, the disclosure of which is incorporated herein by reference in its entirety.

BACKGROUND

The disclosure relates to a hydrostatic axial piston machine having a cylinder drum that rotates during operation and has a plurality of cylinder bores in which displacement pistons that carry out a stroke movement during operation are arranged and each of which, together with the walls of a cylinder bore and a connecting duct to an end face of the cylinder drum, delimits a displacement space with a displacement volume that is dependent on the position of the displacement piston. Each cylinder bore opens out in a control opening in one end face of the cylinder drum. The axial piston machine, which can be in the form of a bent axis machine or of a swash plate machine and can be designed with a fixed displacement volume or with a variable displacement volume, also comprises a control part against which the cylinder drum bears with the end face and on which a first kidney-shaped control port in the form of a circular arc and a second kidney-shaped control port in the form of a circular arc and, between the two kidney-shaped control ports, a first changeover web and a second changeover web are formed, within which the displacement pistons take up a dead center position and reverse their direction of movement. A compensating opening that is able to be overlapped by a control opening is located in each changeover web. The two compensating openings are connected together via a compensating fluid path. In the changeover webs, the pressure changeover between high pressure and low pressure takes place in the displacement spaces.

In hydrostatic axial piston machines, a pressure reducing fluid path without a valve is usually formed by what is known as a pilot groove, which has been introduced into that side of a control plate that faces the cylinder drum and which starts at a distance from a kidney-shaped control port in the control plate, undergoes an increase in cross section toward the kidney-shaped control port and ultimately opens into the kidney-shaped control port. A hydrostatic axial piston machine having such a pilot groove is known for example from DE 17 03 347 A. Specifically, respective pilot grooves are located at each end of each of the two kidney-shaped control ports, and so a total of four pilot grooves are present. A hydrostatic axial piston machine having pilot grooves at the kidney-shaped control ports is also known from DE 37 25 361.

In the case of such a conventional pressure changeover, each displacement space is thus connected, in the region of the dead center position of a displacement piston, to the respectively other pressure level via a notch or a bore as pilot control. Depending on the application, changeover systems with a negative or positive overlap exist. In the case of a positive overlap, there is briefly no connection of the displacement volume to be changed over to a kidney-shaped control port. In the case of a negative overlap, by contrast, there is briefly a connection to both kidney-shaped control ports. The purpose of the pressure changeover is to switch the pressure level in the displacement volume back and forth as gently as possible without abrupt, sudden changes between the two pressure levels of the kidney-shaped control ports. On account of the compressibility of the fluid, an additional amount of pressure fluid is required for compressing the pressure fluid in a closed capacity, while upon relaxation, this amount has to escape again. This has the effect that conventional pressure changeover systems always lose a part of the medium from the high-pressure side to the low-pressure side, this having a negative effect on the efficiency.

In principle, the notches and bores can always be designed optimally only for a narrow operating range. This form of the pressure changeover system has proven successful in the past. On account of the demand for increasing output, namely for higher pressure with a simultaneous increase in speed, the conventional changeover system reaches physical limits, however: The rate of pressure change increases during the changeover phase. In addition, the pressure change is no longer fully achieved during the overlapping phase of the displacement space and pilot control, and so the pressure level in the displacement space changes abruptly as the overlap with the kidney-shaped control ports of the control part continues. As a result, strong pressure shocks are sent into the line system, resulting in high pressure pulsing and volumetric flow (mass flow) pulsing in the low pressure and high pressure system. The pressure pulsing becomes all the greater, the narrower the ducts are dimensioned to be. In 4-quadrant-capable pumps and hydraulic motors that are operated in a closed hydraulic circuit, the flow ducts, for example the ducts in the control lens of a bent axis machine, have to be dimensioned in a narrow manner for strength reasons, this exacerbating the pulsing problem.

For example, the situation for a bent axis motor with a conventional notch changeover system at a high speed will be outlined. This motor is designed with a positive notch overlap, and so there is no connection of the displacement space to be changed over with high or low pressure when a displacement piston is located at top dead center, that is to say passes least far into the cylinder bore. A few rotation angle degrees later, the displacement volume is relaxed into the low-pressure kidney-shaped control port. At the end of the overlapping phase with the changeover notch in front of the low-pressure kidney-shaped control port, the pressure level has only dropped by for example 50%, however. The further relaxation takes place largely without constriction via the direct connection of the low-pressure kidney-shaped control port and the displacement space. As a result of the strong pressure-shock stimulation, the majority of the fluid on the low-pressure side is greatly accelerated by the cylinder drum, this then causing a hydraulic undersupply at the cylinder drum. During this phase, significant evaporation (cavitation) can occur on the low-pressure side, since the fluid, after the pressure-shock wave has leveled off, first of all has to be slowed down in order subsequently to refill the resultant cavities (cavitation bubbles). The starting acceleration toward the cylinder drum allows the steam zones to condense implosively, resulting in very high pressure spikes in the region of the low-pressure side. The implosion of such bubbles in the vicinity of fixed walls results in fatigue-like breakdown of the material structure, resulting in local pitting on the cylinder drum and on the control part.

DE 21 04 933 A1 discloses a hydrostatic axial piston machine in which respective compensating openings are located in the middle of the two changeover webs, and the two compensating openings are connected together by a compensating fluid path. In that case, the angular spacing between a compensating opening and a kidney-shaped control port is at least as large as the angular width of a control opening of a cylinder bore. DE 21 04 933 A1 discloses an axial piston machine with an even number of displacement pistons and an axial piston machine with an odd number of displacement pistons. In such an axial piston machine with an odd number of displacement pistons, the pressure compensation between displacement spaces that change from the low-pressure side to the high-pressure side and displacement spaces that change from the high-pressure side to the low-pressure side takes place in two stages. In that case, the compensating fluid path between the two compensating openings and thus the surrounding material is exposed to highly dynamic loading. This has a negative effect on the durability of the control part in which the compensating fluid path is formed and which is usually a separate control plate or control lens.

SUMMARY

The object of the disclosure is to configure a hydrostatic axial piston machine, in particular a hydrostatic axial piston motor having the features mentioned at the beginning, such that, for both directions of rotation, cavitation that occurs in particular at high speeds is avoided and the noise behavior is good.

This object is achieved, in the case of a hydrostatic axial piston machine having the features mentioned at the beginning, in that the two compensating openings are arranged adjacent to the first kidney-shaped control port, in that a further compensating opening that is able to be overlapped by the control openings is located in each changeover web, said further compensating opening being arranged adjacent to the second kidney-shaped control port, in that the two further compensating openings are connected together via a second compensating fluid path, and in that the angular spacing between the two compensating openings arranged in the same changeover web is greater than the angular width of a control opening. In this case, the vertex of the above-mentioned angles lies preferably on the axis of rotation of the cylinder drum.

In an axial piston machine according to the disclosure, the dynamic load pulses only between 50% high pressure and 100% high pressure in the compensating fluid path between the two high-pressure side compensating openings and only between 0 and 50% high pressure in the compensating fluid path between the two low-pressure side compensating openings. The dynamic loading of a control plate or control lens is therefore low, such that the machine exhibits good durability. Since the angular spacing between the two compensating openings in a changeover web is greater than the angular width of the control openings in the cylinder drum, this ensures that the high-pressure kidney-shaped control port and the low-pressure kidney-shaped control port are not connected together via three control openings and the two compensating fluid paths in a hydraulic short circuit. The function is in this case entirely independent of the direction in which the axial piston machine rotates and in which kidney-shaped control port the high pressure prevails and in which one the low pressure prevails.

A hydrostatic axial piston machine according to the disclosure can be developed further in an advantageous manner.

Preferably, the two compensating openings that are adjacent to a kidney-shaped control port and are connected together via a compensating fluid path have the same angular spacing from the kidney-shaped control port.

In this case, it is furthermore preferred that the two compensating openings that are adjacent to a kidney-shaped control port have the same angular spacing from this kidney-shaped control port as the two compensating openings that are adjacent to the other kidney-shaped control port have from the other kidney-shaped control port. If the two kidney-shaped control ports have the same arc length, this therefore results, in plan view of that side of the control part that faces the cylinder drum, in a symmetric arrangement of the kidney-shaped control ports and of the compensating openings with regard to a plane located centrally between the two kidney-shaped control ports. The ratios are then always the same regardless of which kidney-shaped control port is the high-pressure kidney-shaped control port and which one is the low-pressure kidney-shaped control port and in which direction the axial piston machine rotates.

It is favorable for the strength of the control part when the angular spacing of the compensating openings from the adjacent kidney-shaped control port is at least approximately the same as the angular width of the compensating openings.

The disclosure and its advantageous configurations can be employed with particular advantages in a hydrostatic axial piston machine in which the number of cylinder bores that are present and thus also the number of displacement pistons is odd.

Advantageously, at the start of a compensating flow between two control openings that overlap two compensating openings connected together by a compensating fluid path, there is still a small passage cross section between a control opening leaving a kidney-shaped control port and the kidney-shaped control port. In variable-displacement axial piston machines, the compensating fluid paths can be designed correctly for the capacities to be changed over only in respect of a speed, a delta-p and a displacement volume. However, the design should take into consideration the entire range of operating points with regard to pressure and speed, but also with regard to the variable displacement volume. Preferably, therefore, entirely closed-off capacities which are formed by the displacement spaces are avoided. The complete shutting off of a displacement space during the piston stroke has the result that, depending on the piston movement, extreme positive pressures (when reducing the displacement space capacity) or even negative pressures (when increasing the displacement space capacity) arise. Consequently, extreme pulsing should be expected both on the low-pressure side and on the high-pressure side. The intake behavior could also be impaired, this being problematic in particular in the case of a machine used in an open circuit.

It is likewise advantageous when, toward the end of a compensating flow between two control openings that overlap two compensating openings connected together by a compensating fluid path, the control opening that has left a kidney-shaped control port only comes out of overlap with the corresponding compensating opening when the other control opening is still overlapping the other compensating opening and there is already a small passage cross section between the other control opening and the kidney-shaped control port.

Since the outlined overlap is allowed, the angle over which the kidney-shaped control ports extend can be very large, and so extreme positive pressures when a displacement space is reduced in size or even negative pressures when a displacement space is increased in size and thus strong pulsing both on the low-pressure side and on the high-pressure side are avoided.

At the start and toward the end of a compensating flow, the inductance of the oil column in a compensating fluid path has a significant influence on the dynamics of the changeover. Since the compensating fluid paths, which are preferably formed by bored holes, i.e. by a plurality of individual bores, are relatively long and thin, some time is required before the oil column in a compensating fluid path is accelerated and before the direction of flow in a compensating fluid path changes under reversing pressure conditions and the pressure fluid flows counter to the original direction. In the case of a hydrostatic axial piston machine according to the disclosure, this operation takes place once for each individual compensating fluid path per changeover operation. These dynamics can be considered when determining the opening angle of the kidney-shaped control ports. It is advantageous for the kidney-shaped control ports to be embodied in a shorter manner in the specific application of an axial piston machine that tends to run slowly than in an axial piston machine that tends to run quickly, in order to reduce the opening area, or for the kidney-shaped control ports to be embodied in a longer manner in the specific application of axial piston machines that tend to run quickly than in axial piston machines that tend to run slowly, in order to increase the opening area.

If the displacement volume of the hydrostatic axial piston machine is variable, then preferably, at the minimum displacement volume, the volume of the compensating fluid path between two compensating openings is less than one tenth of the free volume of a displacement space at the inner dead center of the displacement piston. The inner dead center should be understood as being the dead center with the smallest cylinder volume. It is thus clear that a compensating fluid path does not represent a volume known from the prior art in the form of a precompression volume or decompression volume. A precompression volume is initially charged to high pressure and, during a drop in pressure, sends pressure fluid to a displacement space which is changing to the kidney-shaped control port subjected to high pressure and in which the pressure is rising. Then, the precompression volume is charged back up to high pressure from the high-pressure kidney-shaped control port via the control opening of the displacement space. In a decompression volume, low pressure initially prevails before pressure fluid flows to it during a pressure rise from a displacement space which is changing from the high-pressure kidney-shaped control port to the low-pressure kidney-shaped control port and in which the pressure is dropping. Then, via the control opening of the displacement space, the decompression volume is connected to the low-pressure kidney-shaped control port and the pressure in the decompression volume drops to low pressure again.

A hydrostatic axial piston machine usually has a control plate which is separate from a housing part with the working ports and in which the kidney-shaped control ports are located. In an axial piston machine of bent axis design with a variable displacement volume, during an adjustment, the control plate moves along with the cylinder drum and has a lens-like shape, for which reason it is also known as a control lens. Preferably, in addition to the kidney-shaped control ports and the compensating openings, the compensating fluid paths are also located between the compensating openings entirely in the separate control plate, in particular in the control lens that is moved with the cylinder drum during adjustment of the displacement volume.

The advantages of a hydrostatic axial piston machine according to the disclosure come to bear especially when the two kidney-shaped control ports are able to be subjected to high pressure and to low pressure, as is the case in particular when used in a closed hydraulic circuit.

BRIEF DESCRIPTION OF THE DRAWINGS

An exemplary embodiment of a hydrostatic axial piston machine of bent axis design according to the disclosure and two variants of a control lens with compensating openings and compensating fluid paths are illustrated in the drawings. The disclosure will now be explained in more detail on the basis of the figures of these drawings, in which.

DETAILED DESCRIPTION

Figure 1:
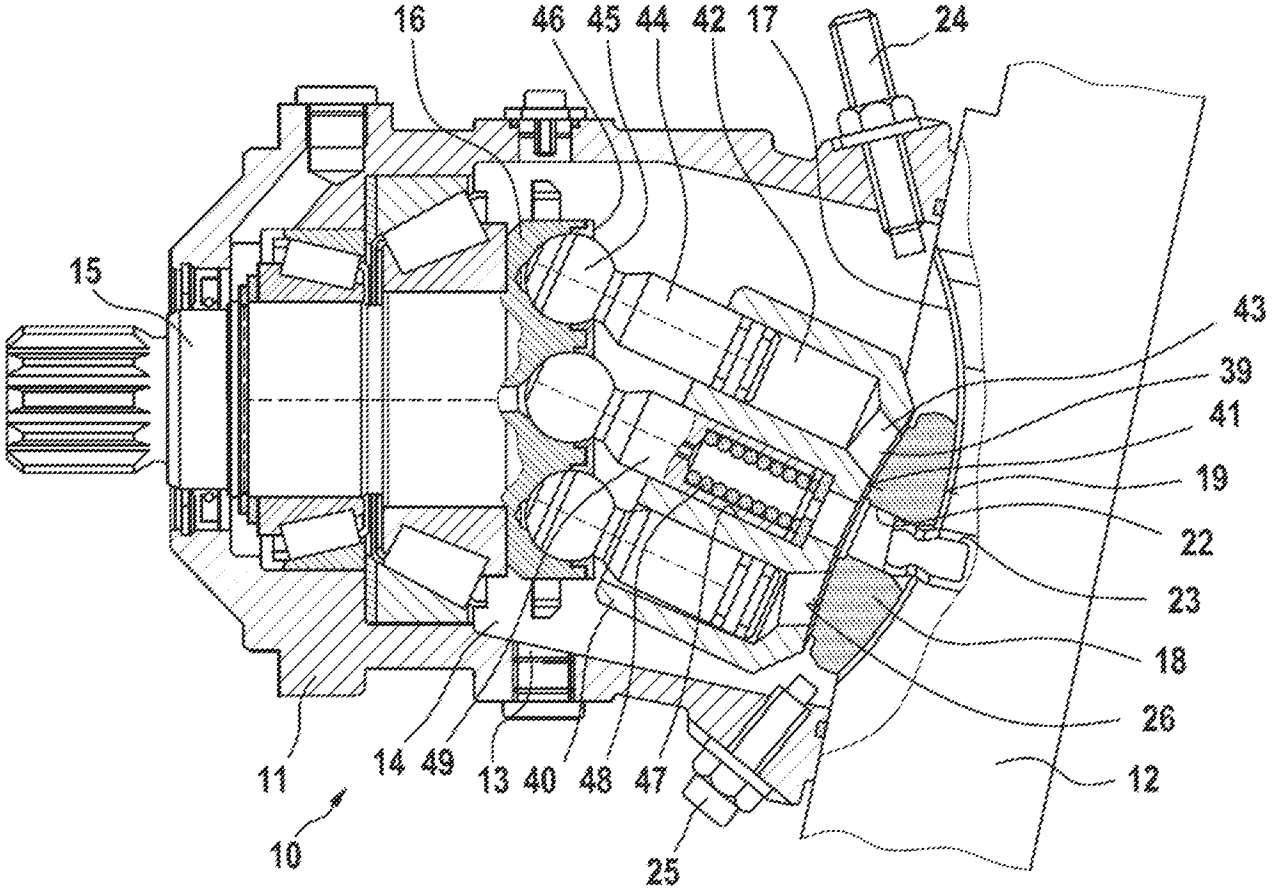
FIG. 1 shows a longitudinal section through the hydrostatic axial piston machine in the form of a bent axis machine.

The variable-displacement hydrostatic axial piston machine of bent axis design illustrated in FIG. 1 is used primarily as a hydraulic motor in a closed hydraulic circuit and is operable in opposite directions of rotation. It comprises a two-part housing 10 with a substantially pot-like housing part 11 and with an end plate 12 which has two working ports that are able to be subjected alternately to high pressure or low pressure, and which closes the housing part 11 on its open side. Formed in the housing part 11 is a leakage oil port 13, via which the interior 14, filled with pressure fluid, of the housing 10 is able to be connected to a tank. Therefore, tank pressure prevails in the housing 10 during operation.

A drive shaft 15 having a drive flange 16 is mounted in a rotatable manner in the housing part 11 in an O arrangement by means of two tapered roller bearings.

The end plate 12 has, facing the interior 14, two axially spaced-apart circular-cylindrical, hollow bearing faces 17, on which a control plate 18 with corresponding bearing faces 19 bears and along which the control plate is displaceable by an adjusting device, of which only the adjusting pin 23 that dips into a central bore 22 in the control plate 18 is visible in FIG. 1, in order to adjust the displacement volume. Adjustable stops 24 and 25 in the housing 11 delimit the adjusting region of the control plate 18. Facing away from the end plate 12, the control plate has for example a spherically curved, convex control face 26, wherein the control face (26) can also be formed in a planar manner. On account of this spherically curved control face and on account of the circular-cylindrical bearing faces 19, the control plate is also referred to as a control lens.

The control plate 18 has, from the control face 26 to the bearing faces 19, two apertures 30 and 31, which open, in the control face 26, into two kidney-shaped control ports 32 and 33 in the form of a circular arc that lie on a pitch circle. The aperture 30 opens out in one bearing face 19 as an elongate, rectangular slot 34, and the aperture 31 opens out in the other bearing face 19 as an elongate, rectangular slot 35. Located in each bearing face 17 of the end plate 12 is a slot (not apparent in the section according to FIG. 1), which is fluidically connected to a working port formed on the end plate and which is overlapped, in each position of the control plate 18, by the rectangular slot 34 or 35 and is sealed off by a gap seal in the direction of the interior 14 of the housing 10 all around the slots 34 and 35 by abutment of the bearing faces 17 and 19 against one another. Thus, there is always a fluid connection from the one kidney-shaped control port to the one working port and from the other kidney-shaped control port to the other working port. Between the kidney-shaped control ports 32 and 33, changeover webs 36 and 37 are located in the control face 26.

The axial piston machine furthermore comprises a cylinder drum 40, which is arranged between the drive flange 16 and the control plate 18. The cylinder drum 40 is supported on the control face 26 of the control plate 18 in a hydrostatically mounted manner with an appropriately adapted end face as bearing face 41. In the cylinder drum 40, for example seven or nine axially extending cylinder bores 42 that are distributed uniformly on a pitch circle are formed, which open out on the planar end face of the cylinder drum 40 that faces the drive flange 16. At the concave bearing face 41 of the cylinder drum 40, the cylinder bores 42 open out via opening ducts 43, extending obliquely toward a central axis of the cylinder drum, on the pitch circle on which the kidney-shaped control ports 32 and 33 of the control plate 18 also lie. The mouths of the opening ducts on the bearing face 41 form control openings 39 of the cylinder bores 42 and have a width which is equal to the width of the kidney-shaped control ports and are curved like the kidney-shaped control ports. Their length on the pitch circle is slightly smaller than the diameter of a cylinder bore. In the cylinder bores 42, pistons 44 are arranged so as to be movable back and forth. Their free ends that project out of the cylinder bores 42 are connected to the drive flange 16 so as to be able to be entrained in rotation via ball joints. Each ball joint consists of a ball head 45 formed at the free end of the associated piston 44 and of a hollow sphere portion which is formed in the drive flange 16 and in which the ball head 45 is received in a rotatable manner. A retaining plate 46 keeps the ball heads 45 within the hollow sphere portions.

Fitted in a central, stepped through-bore 47 in the cylinder drum 40 is a helical compression spring 48, which supports a central pin 49 on the drive flange 16, said central pin 49 likewise being mounted by means of a ball joint in the drive flange 16, projecting into the through-bore 47 and guiding the cylinder drum 40.

Figure 2:
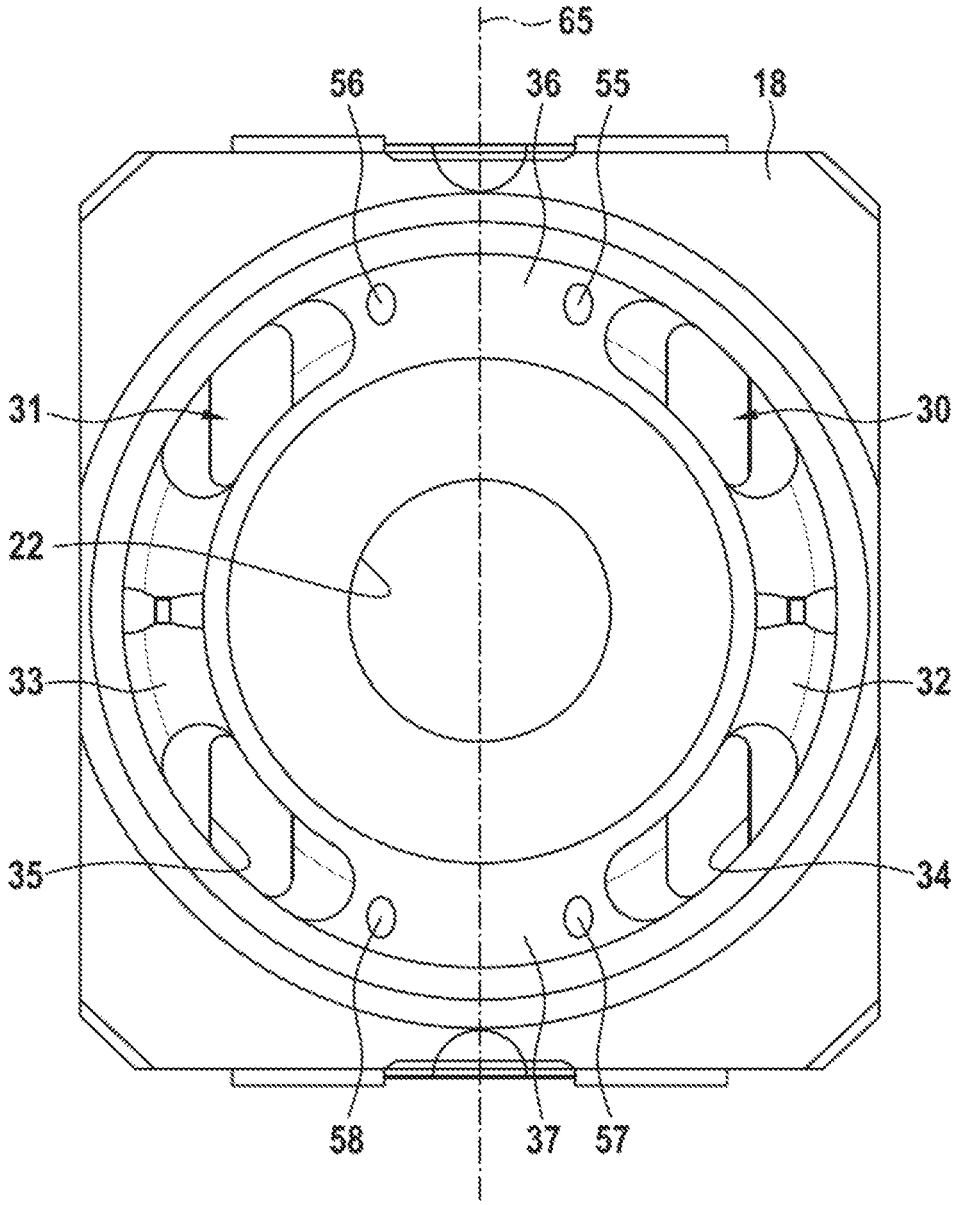
FIG. 2 shows a view of the control lens from FIG. 1 in the direction of its central axis.
Figure 3:
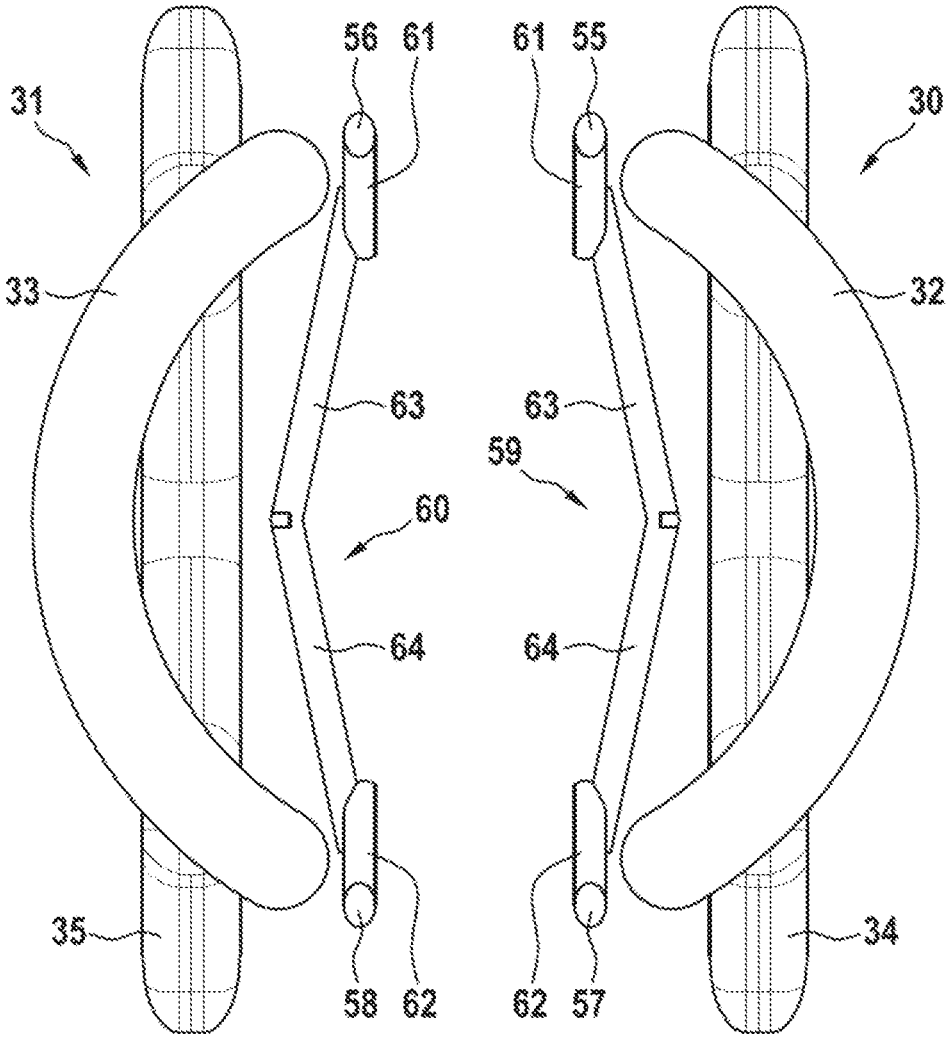
FIG. 3 shows a view of cavities, filled with flowing pressure fluid, of the control lens from FIG. 2, FIGS. 4*a* to 4*h* show plan views of a control lens, illustrated in a simplified manner as a circular control plate, with kidney-shaped control ports and compensating fluid paths in different angular positions of the control openings of a cylinder drum with nine cylinder bores.

As is more clearly apparent from FIGS. 2 and 3, two compensating openings 55 and 56 are located in the control face 26 in the changeover web 36 of the control lens 18 and two compensating openings 57 and 58 are located in the changeover web 37, in each case one of said compensating openings being arranged adjacent to the kidney-shaped control port 32 and the other being arranged adjacent to the kidney-shaped control port 33. The compensating openings lie for example on the same pitch circle as the kidney-shaped control ports and are passed over, in operation, by the control openings 39 in the cylinder drum 40. All the compensating openings 55, 56, 57 and 58 are the same size and have the same spacing from the adjacent kidney-shaped control port 32, 33. Specifically, the spacing is about the same size as the smallest diameter of the compensating openings. These have, in the control face, the shape of an ellipse or of a circle, depending on the orientation of the introduced bore.

The two compensating openings 55 and 57 adjacent to the kidney-shaped control port 32 are connected fluidically together by a first compensating fluid path 59 and the two compensating openings 56 and 58 adjacent to the kidney-shaped control port 33 are connected fluidically together by a second compensating fluid path 60. Both compensating fluid paths 59 and 60 are produced by bored holes within the control lens 18. Specifically, each compensating fluid path is made up of an oblique bore 61, which extends from the control face 26 and the mouth of which forms the compensating opening 55 or 56, respectively, an oblique bore 62, which likewise extends from the control face 26 and the mouth of which forms the compensating opening 57 or 58, respectively, and two further bores 63 and 64 that meet one another, intersect the oblique bores 61 and 62 and guide the respective compensating fluid path around the central bore 22 in the control lens 18. Toward the outside, the bores 63 and 64 are closed in a manner not illustrated in more detail by a stopper.

Overall, the control lens 18 is thus entirely symmetric with respect to a plane 65 in which the axis of the central bore 22 of the control lens lies and which extends centrally between the two kidney-shaped control ports 32 and 33 through the changeover webs 36 and 37. The bores 61, 62, 63 and 64 are clearly discernible in FIG. 3 as cavities within the control lens 18.

The control lens 18 according to FIGS. 4*a* to 4*h* is provided for an axial piston machine having a cylinder drum with nine cylinder bores 42, that is to say with nine displacement pistons. The axial piston machine thus has an odd number of displacement pistons, just like one with seven displacement pistons. The cylinder bores 42 are indicated in FIGS. 4*a* to 4*h*, as are their elongate control openings 39, the radial width of which is equal to the width of the kidney-shaped control ports and the angular width of which is slightly less than the angular width of the cylinder bores. Like the control lens according to FIG. 2, the control lens 18 according to FIGS. 4*a* to 4*h* also has two compensating openings 55 and 56 in the changeover web 36 and two compensating openings 57 and 58 in the changeover web 37, in each case one of said compensating openings being arranged adjacent to the kidney-shaped control port 32 and the other being arranged adjacent to the kidney-shaped control port 33. In FIGS. 4*a* to 4*h*, the complete symmetry of the control lens with regard to the plane 65 is likewise discernible. The two compensating fluid paths 59 and 60 are illustrated in a simplified manner in FIGS. 4*a* to 4*h* inasmuch as the connection between the two oblique bores 61 and 62 of one compensating fluid path has been established by a single bore.

In order to distinguish them better from one another, in FIGS. 4*a* to 4*h* the cylinder bores 42 are designated more specifically as cylinder bores 42.1 to 42.9 and the control openings 39 are designated more specifically as control openings 39.1 to 39.9.

It is now assumed that the axial piston machine is operated as a hydraulic motor in a closed hydraulic circuit and pressure fluid delivered by a pump flows to the working port to which the kidney-shaped control port 32 is connected. In the kidney-shaped control port 32, high pressure thus prevails in the control lens 18 and low pressure at a level of for example 30 bar prevails in the kidney-shaped control port 33. The cylinder drum 40 rotates, in the plan view according to FIGS. 4*a* to 4*h*, counterclockwise relative to the control lens 18. FIGS. 4*a* to 4*h* show the rotation of the cylinder drum in increments of five degrees. Each control opening 39 of a cylinder bore 42 successively passes over the kidney-shaped control port 32 subjected to high pressure, then over the changeover web 36, then over the kidney-shaped control port 33 subjected to low pressure, then over the changeover web 37, and finally over the kidney-shaped control port 32 again, wherein in the control opening and the cylinder bore a pressure change from high pressure to low pressure takes place in the changeover web 36 and a pressure change from low pressure to high pressure takes place in the changeover web 37.

Figure 4A:
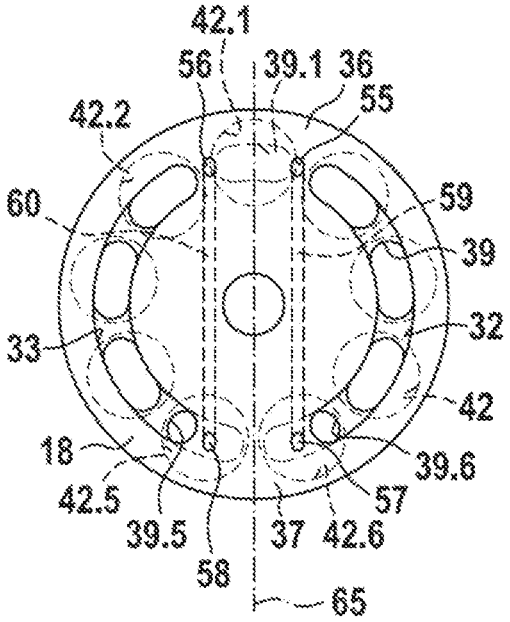

In the rotational position of the cylinder drum 40 relative to the control lens 18 according to FIG. 4*a*, a control opening 39.1 is located in the changeover web 36 precisely between the two compensating openings 55 and 56, i.e. is open neither toward the compensating opening 55 nor toward the compensating opening 56. Thus, a fluidic connection between the two kidney-shaped control ports 32 and 33 is avoided. The pressure in this control opening 39.1 is already lower than the high pressure, but still higher than the low pressure. A control opening 39.5 is in the process of leaving the kidney-shaped control port 33 and is still wide open toward the kidney-shaped control port 33 and already open toward the compensating opening 58. Low pressure prevails in this control opening 39.5. Low pressure also prevails in the compensating fluid path 60. A control opening 39.6 is in the process of opening more and more toward the kidney-shaped control port 32 and is still open toward the compensating opening 57. A pressure level below the high-pressure level (for example about ¾ of the high-pressure level) prevails in the compensating fluid path 59.

Figure 4B:
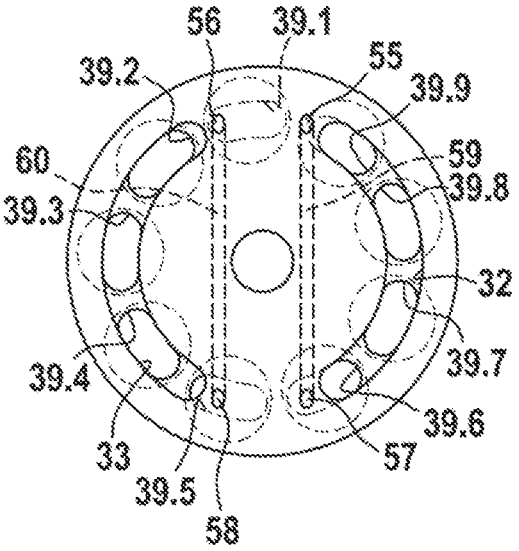

Once the cylinder drum 40 has rotated five degrees further into the position shown in FIG. 4*b*, the control opening 39.5 is still, if less, open toward the kidney-shaped control port 33 and continues to be open toward the compensating opening 58. The control opening 39.1 now overlaps the compensating opening 56 and the pressure fluid in the compensating fluid path 60 is accelerated toward the control opening 39.5. A control opening 39.9 is in the process of leaving the kidney-shaped control port 32 and is currently opening toward the compensating opening 55. For the compensating fluid path 59, the pressure level has increased to the high-pressure level again.

Figure 4C:
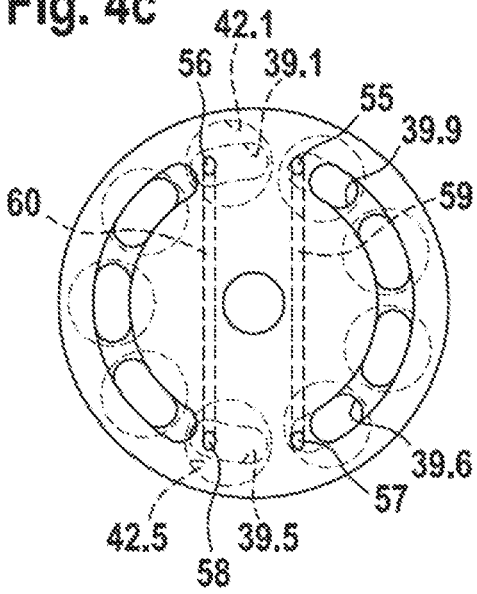

Once the cylinder drum 40 has rotated five degrees further into the position shown in FIG. 4*c*, the control opening 39.1 and the control opening 39.5 continue to be fully open toward the compensating openings 56 and 58. Moreover, in the position of the cylinder drum shown in FIG. 4*c*, there is a respective very small opening cross section both between the control opening 39.1 and the kidney-shaped control port 33 and between the control opening 39.5 and the kidney-shaped control port 33, wherein the two opening cross sections are the same size and the ratio between the cross-sectional area of a compensating opening and an opening cross section toward the kidney-shaped control port 33 is greater than two. As a result of pressure medium flowing via the compensating flow path 60 from the cylinder bore 42.1 belonging to the control opening 39.1 into the cylinder bore 42.5 belonging to the control opening 39.5, the pressure rises in the latter to higher than the low pressure, while it drops in the cylinder bore 42.1. The control opening 39.6 and the control opening 39.9 continue to overlap both the compensating bores 55 and 57 and the kidney-shaped control port 32. For the compensating fluid path 59 nothing continues to have changed.

Figure 4D:
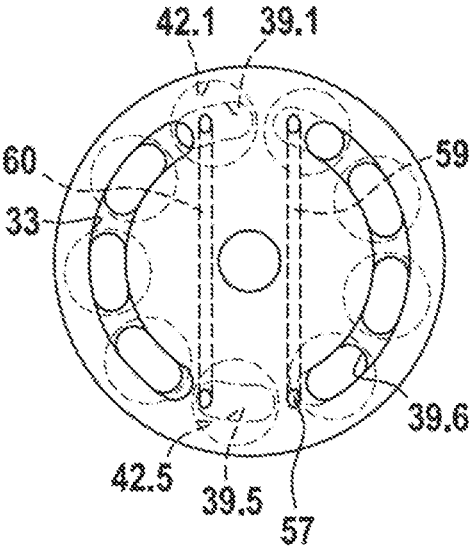

Once the cylinder drum 40 has rotated five degrees further into the position shown in FIG. 4*d*, the opening cross section between the control opening 39.1 and the kidney-shaped control port 33 has become greater than the cross-sectional area of the compensating bore 56 and the pressure in the cylinder bore 42.1 becomes lower than in the cylinder bore 42.5. Since some time is required before the direction of flow of the pressure fluid in the compensating fluid path 60 changes under reversing pressure conditions and the pressure fluid flows counter to the original direction, the higher pressure remains in the cylinder bore 42.5 until the control opening 39.5 has come out of overlap with the compensating opening 58. This has happened after a further rotation of the cylinder drum 40 into the rotational position shown in FIG. 4*e*. In the rotational position according to FIG. 4*d*, the control opening 39.6 has left the compensating opening 57. For the compensating fluid path 59, nothing continues to have changed. High pressure continues to prevail therein.

Figure 4E:
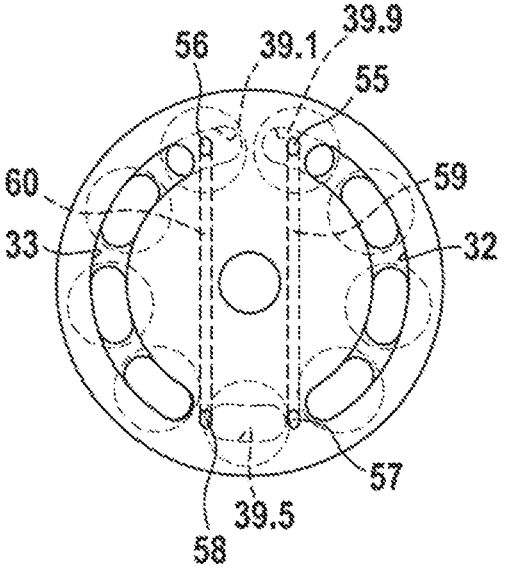

In the rotational position, shown in FIG. 4*e*, of the cylinder drum 40 relative to the control lens 18, the control opening 39.1 continues to be open both toward the kidney-shaped control port 33 and toward the compensating opening 56, and so the pressure in the compensating fluid path 60 drops to the low pressure. The control opening 39.9 continues to be open both toward the kidney-shaped control port 32 and toward the compensating opening 55. The control opening 39.5 is located between the two compensating openings 58 and 57, and so, via the control openings 39.1, 39.9 and the two compensating fluid paths 59 and 60, there is no fluidic connection between the kidney-shaped control ports 32 and 33 and thus between high pressure and low pressure. Such a connection would impair the efficiency of the axial piston machine.

Figure 4F:
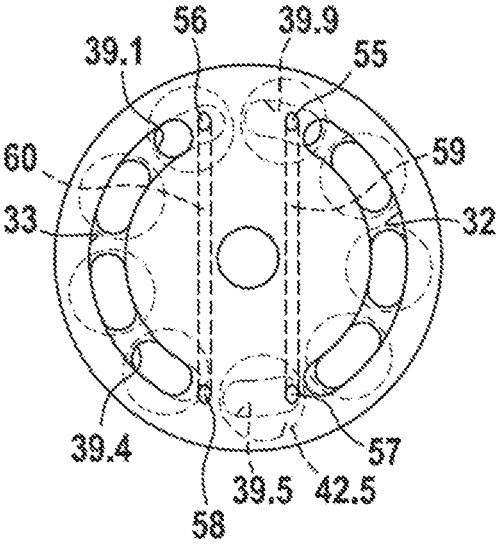

After a further rotation through five degrees, i.e. after a rotation of 25 degrees in total starting from the rotational position according to FIG. 4*a*, the cylinder drum has reached the rotational position according to FIG. 4*f* The control opening 39.1 continues to be open both toward the kidney-shaped control port 33 and toward the compensating opening 56. The low pressure thus prevails therein. The control opening 39.9 continues to be open toward the kidney-shaped control port 32 and toward the compensating opening 55. The control opening 39.5 has opened toward the compensating opening 57. Thus, as a result of the higher pressure in the control opening 39.9 compared with the pressure in the control opening 39.5, the pressure fluid in the compensating fluid path 59 is accelerated. Pressure fluid flows toward the control opening 39.5, with the result that the pressure in this control opening and in the cylinder bore 42.5 increases further from the level that is already above the low pressure, while the pressure in 39.9 (42.9) drops as a result of pressure fluid flowing out to the control opening 39.5. The control opening 39.4 now reaches the compensating opening 58, but nothing changes in the compensating fluid path 60 as a result.

Figure 4G:
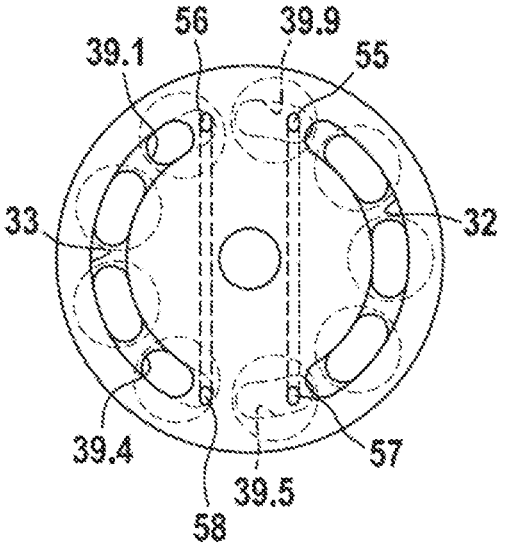

While the cylinder drum 40 is on its way to the rotational position according to FIG. 4*g*, the pressure in the control opening 39.5 increases further, while the pressure in the control opening 39.9 drops to a value below the high pressure and above the low pressure. In the rotational position according to FIG. 4*g*, the opening cross section between the control opening 39.9 and the kidney-shaped control port 32 is the same size as the opening cross section between the control opening 39.5 and the kidney-shaped control port 32 and in turn very small. The control openings 39.1 and 39.4 are equally wide open toward the kidney-shaped control port 33 and also toward the compensating openings 56 and 58, and so low pressure continues to prevail in the compensating fluid path.

Figure 4H:
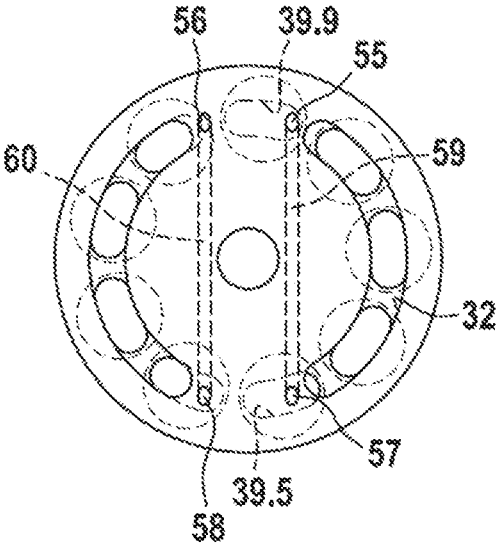

During the rotation of the cylinder drum 40 through a further five degrees into the rotational position shown in FIG. 4*h* and during the rotation beyond this position, the opening cross section between the control opening 39.5 and the kidney-shaped control port 32 becomes larger and larger and the pressure in the control opening 39.5 increases to the high-pressure level. The control opening 39.9 initially continues to remain open toward the compensating opening 55. In spite of the now higher pressure in the control opening 39.5 compared with the pressure in the control opening 39.9, no pressure medium flows back to the control opening 39.9 via the compensating fluid path 59. This is because the inductance of the oil column in a compensating fluid path has a significant influence on the dynamics of the changeover. Since the compensating fluid paths are relatively long and thin, some time is required before the oil column in a compensating fluid path is accelerated and before the direction of flow in a compensating fluid path changes under reversing pressure conditions and the pressure fluid flows counter to the original direction. In a hydrostatic axial piston machine according to the disclosure, this operation happens once for each individual compensating fluid path per changeover operation. These dynamics can be considered when setting the opening angle of the kidney-shaped control ports.

In the control lens 18 shown in FIGS. 4*a* to 4*h*, the clear angular spacing of the compensating openings 55, 56, 57 and 58 from the adjacent kidney-shaped control port 32, 33 is exactly the same size as the angular width of a compensating opening. The control lens according to FIGS. 4*a* to 4*h* is intended for use in axial piston machines that tend to run slowly. In axial piston machines that tend to run quickly, it is advantageous to use a control lens with longer kidney-shaped control ports, such that the opening cross section between a control opening 39 and a kidney-shaped control port 32, 33 is increased in size in particular angular positions of the cylinder drum relative to the control lens.

Figure 5A:
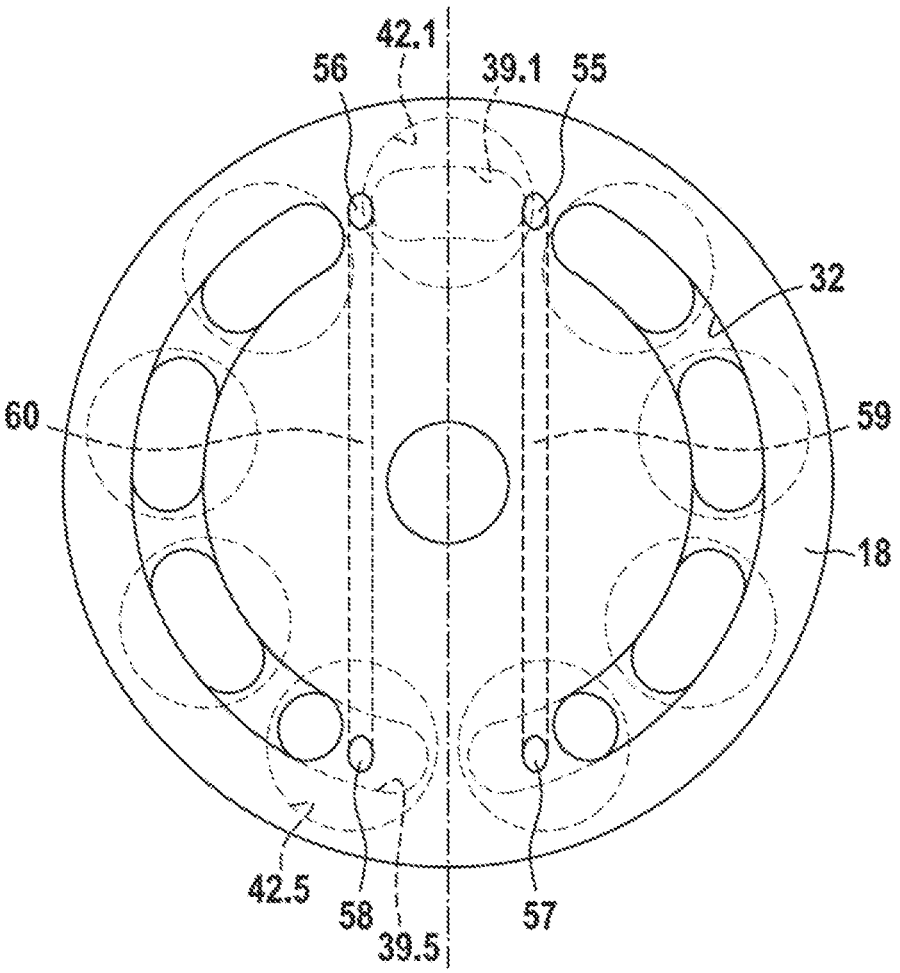
FIG. 5*a* shows a plan view of a control plate, which is slightly modified compared with the control plate from FIG. 4, in positions of the control openings according to FIGS. 4*a*.
Figure 5B:
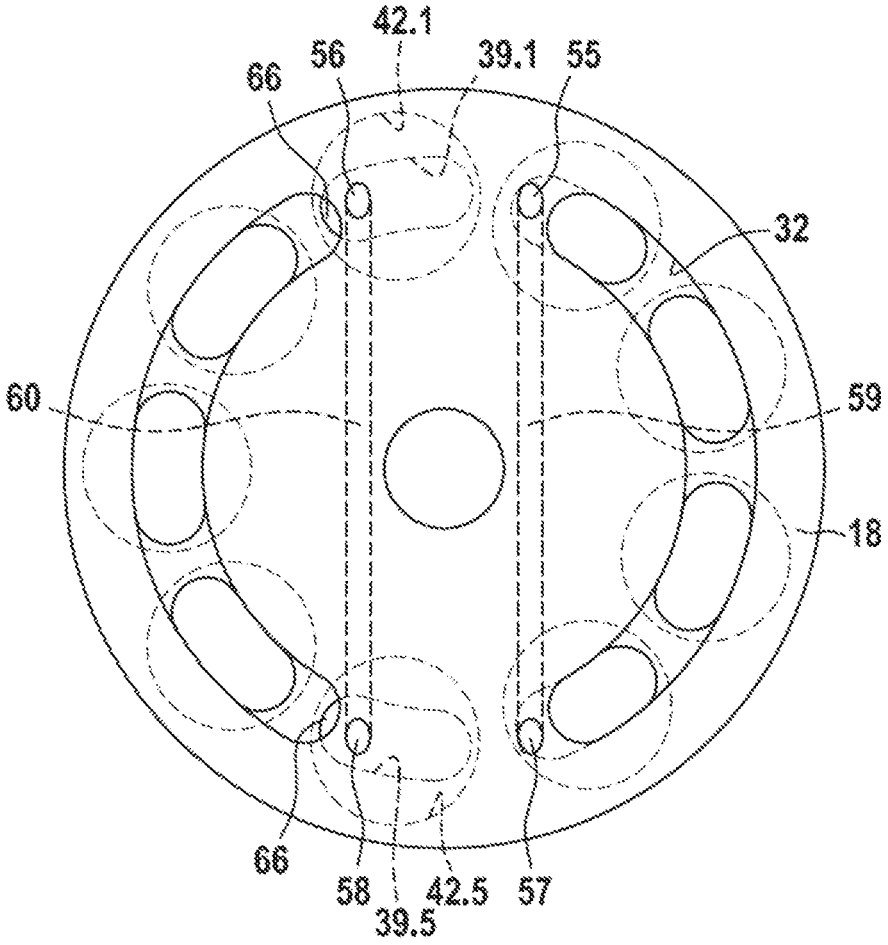
FIG. 5*b* shows a plan view of the control plate according to FIG. 5*a* in positions of the control openings according to FIG. 4*c*.

Such a control lens 18 is shown in FIGS. 5*a* and 5*b*. The positions of the control openings 39 relative to the control lens in FIG. 5*a* correspond to the positions according to FIG. 4*a* and the positions of the control openings 39 relative to the control lens in FIG. 5*b* correspond correspond to the positions according to FIG. 4*c*. The arrangement and size of the compensating openings 55, 56, 57 and 58 are chosen to be the same in the control lens 18 according to FIGS. 5*a* and 5*b* as in the control lens according to FIGS. 4*a* to 4*h*. It is apparent that the kidney-shaped control ports 32 and 33 of the control lens according to FIGS. 5*a* and 5*b* extend closer to the compensating openings than in the control lens according to FIGS. 4*a* to 4*h*, wherein the angular spacing between the compensating openings and the adjacent kidney-shaped control port is in turn the same for all compensating openings. This has the result that, in the positions, corresponding to FIG. 4*c*, of the control openings 39 relative to the control lens 18 according to FIG. 5*b*, the same-sized opening cross sections 66 between the control openings 39.1 and 39.5 are larger than in the use of the control lens according to FIGS. 4*a* to 4*h*, this also being the case for the same-sized opening cross sections between the control openings 39.5 and 39.9 in the positions, corresponding to FIG. 4*g*, of the control openings relative to the control lens.

If pressure fluid delivered by a pump flows to the working port, connected to the kidney-shaped control port 33, of the axial piston machine, the cylinder drum 40 rotates clockwise relative to the control plate 18 in the views according to FIGS. 2, 4*a* to 4*h* and 5. The pressure compensation between the displacement spaces via the fluid paths 59 and 60 then takes place analogously to counterclockwise rotation. A position of the cylinder bores 42 and of the control openings 39 according to FIG. 4*a* is then followed, in 5-degree increments, by the positions according to FIGS. 4*h*, 4*g*, 4*f*, 4*e*, 4*d*, 4*c* and 4*b* in that order.

LIST OF REFERENCE SIGNS

10 Two-part housing
11 Housing part of 10
12 End plate of 10
13 Leakage oil port in 11
14 Interior of 10
15 Drive shaft
16 Drive flange
17 Hollow bearing faces on 12
18 Control plate
19 Bearing faces on 18
22 Central bore in 18
23 Adjusting pin
24 Adjustable stop
25 Adjustable stop
26 Control face of 18
27 Channel in 18
30 Aperture in 18
31 Aperture in 18
32 Kidney-shaped control port in 18
33 Kidney-shaped control port in 18
34 Rectangular slot in 18
35 Rectangular slot in 18
36 Changeover web in 26
37 Changeover web in 26
39 Control opening of 42
40 Cylinder drum
41 Bearing face on 40
42 Cylinder bore in 40
43 Opening duct of 42
44 Piston in 42
45 Ball head of 44
46 Retaining plate for 44
47 Through-bore in 40
48 Helical compression spring
49 Central pin
55 Compensating opening
56 Compensating opening
57 Compensating opening
58 Compensating opening
59 First compensating fluid path
60 Second compensating fluid path
61 Oblique bore
62 Oblique bore
63 Bore
64 Bore
65 Plane of symmetry
66 Opening cross section

What is claimed is:

1. A hydrostatic axial piston machine, comprising:

a cylinder drum configured to rotate during operation and including a plurality of cylinder bores in which respective displacement pistons that carry out a stroke movement during operation are arranged, each of the plurality of cylinder bores opening out in a respective control opening in an end face of the cylinder drum;

a control part against which the cylinder drum bears with the end face and on which a first kidney-shaped control port in the form of a circular arc and a second kidney-shaped control port in the form of a circular arc and, between the two kidney-shaped control ports, a first changeover web and a second changeover web are formed, wherein a first compensating opening configured to be overlapped by the respective control openings is located in each changeover web, and the first compensating openings are connected together via a first compensating fluid path, wherein the first compensating openings are arranged adjacent to the first kidney-shaped control port;

a second compensating opening configured to be overlapped by the respective control openings is located in each changeover web, said second compensating opening arranged adjacent to the second kidney-shaped control port;

the two second compensating openings are connected together via a second compensating fluid path; and an angular spacing between the first and second compensating openings arranged in the same changeover web is greater than an angular width of a control opening.

2. The hydrostatic axial piston machine according to claim 1, wherein the first compensating openings have the same angular spacing from the first kidney-shaped control port.

3. The hydrostatic axial piston machine according to claim 2, wherein the first compensating openings have the same angular spacing from the first kidney-shaped control port as the second compensating openings that are adjacent to the second kidney-shaped control port have from the second kidney-shaped control port.

4. The hydrostatic axial piston machine according to claim 2, wherein the angular spacing of the first compensating openings from the first kidney-shaped control port is substantially the same as the angular width of the first and second compensating openings.

5. The hydrostatic axial piston machine according to claim 1, wherein the number of cylinder bores that are present, and thus also the number of displacement pistons, is an odd number.

6. The hydrostatic axial piston machine according to claim 1, wherein each of the first and second compensating fluid paths are formed by a respective plurality of bores that meet one another.

7. The hydrostatic axial piston machine according to claim 1, wherein, at the start of a compensating flow between two control openings (39) that overlap the first compensating openings, there is still a passage cross section between a control opening (39) leaving the first kidney-shaped control port and the first kidney-shaped control port.

8. The hydrostatic axial piston machine according to claim 1, wherein the first compensating openings and the first kidney-shaped control port are configured such that toward the end of a compensating flow between two control openings that overlap the first compensating openings, the control opening of the two control openings that has left the first kidney-shaped control port only comes out of overlap with the corresponding first compensating opening when the other control opening of the two control openings is still overlapping the other first compensating opening and there is already a passage cross section between the other control opening of the two control openings and the first kidney-shaped control port.

9. The hydrostatic axial piston machine according to claim 6, wherein the first compensating openings and the first kidney-shaped control port are configured such that in a position of two control openings in which a first of the two control openings overlaps a first of the first compensating openings and a second of the two control openings overlaps a second of the first compensating openings, and the first of the two control openings and the first kidney-shaped control port and the second of the two control openings and the first kidney-shaped control port overlap with overlapping areas of the same size, the ratio of the cross-sectional area of the first of the first compensating opening to the cross-sectional area of the overlapping area is greater than two.

10. The hydrostatic axial piston machine according to claim 1, wherein:

a displacement volume of the hydrostatic axial piston machine is variable between a minimum displacement volume and a maximum displacement volume; and at the minimum displacement volume, the volume of the first compensating fluid path is less than one tenth of a free volume of a cylinder bore at an inner dead center position of the displacement piston.

11. The hydrostatic axial piston machine according to claim 1, wherein the first and second kidney-shaped control ports, the first and second compensating openings, and the first and second compensating fluid paths are located in a control plate which is supported on a housing part.

12. The hydrostatic axial piston machine according to claim 10, wherein:

the hydrostatic axial piston machine is a variable-displacement bent axis machine with a control lens which is adjustable together with the cylinder drum; and the first and second compensating fluid paths are partially formed in the control lens.

13. The hydrostatic axial piston machine according to claim 1, wherein the hydrostatic axial piston machine is configured such that the first and second kidney-shaped control ports are subjectable to high pressure and to low pressure.

* * * * *